US010714905B2

(12) United States Patent
Shigenaga et al.

(10) Patent No.: US 10,714,905 B2
(45) Date of Patent: Jul. 14, 2020

(54) SPARK PLUG FOR INTERNAL COMBUSTION ENGINE

(71) Applicant: DENSO CORPORATION, Kariya, Aichi-pref. (JP)

(72) Inventors: Masahiro Shigenaga, Nisshin (JP); Fumiaki Aoki, Nisshin (JP); Akimitsu Sugiura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/452,894

(22) Filed: Jun. 26, 2019

(65) Prior Publication Data

US 2020/0006925 A1 Jan. 2, 2020

(30) Foreign Application Priority Data

Jun. 27, 2018 (JP) ..... 2018-121715

(51) Int. Cl.

| | |
|---|---|
| ***H01T 13/32*** | (2006.01) |
| ***H01T 13/54*** | (2006.01) |
| ***H01T 13/06*** | (2006.01) |
| ***H01T 13/34*** | (2006.01) |

(52) U.S. Cl.

CPC ..... *H01T 13/32* (2013.01); *H01T 13/06* (2013.01); *H01T 13/34* (2013.01); *H01T 13/54* (2013.01)

(58) Field of Classification Search

CPC ..... H01T 13/06; H01T 13/34; H01T 13/54
See application file for complete search history.

(56) References Cited

U.S. PATENT DOCUMENTS

| | | | | |
|---|---|---|---|---|
| 6,013,973 | A | 1/2000 | Sato | |
| 2007/0204813 | A1 | 9/2007 | Arai et al. | |
| 2011/0148274 | A1* | 6/2011 | Ernst | H01T 13/467 313/141 |
| 2012/0242215 | A1 | 9/2012 | Hwang et al. | |

FOREIGN PATENT DOCUMENTS

| | | |
|---|---|---|
| JP | 06-159063 | 6/1994 |
| JP | 2005-315144 | 11/2005 |
| JP | 2007-113461 | 5/2007 |
| JP | 2011-122515 | 6/2011 |
| JP | 2013-185515 | 9/2013 |
| JP | 2015-190338 | 11/2015 |
| JP | 2017-228394 | 12/2017 |
| JP | 2018-006304 | 1/2018 |

* cited by examiner

*Primary Examiner* — Anne M Hines
(74) *Attorney, Agent, or Firm* — Nixon & Vanderhye P.C.

(57) ABSTRACT

A spark plug for an internal combustion engine includes a housing, an insulator, a center electrode, a ground electrode, and a plug cover. The housing has a cylindrical shape. The insulator is held on an inner side of the housing. The insulator has a cylindrical shape. The center electrode is held on an inner side of the insulator. The ground electrode forms a discharge gap with the center electrode. The plug cover, together with the housing, configures an auxiliary combustion chamber in which the discharge gap is arranged. The plug cover includes a spray hole that communicates between the inside and outside of the plug cover. The ground electrode is connected to a plurality of locations on an auxiliary-chamber inner wall surface that includes surfaces of the housing and the plug cover that are exposed to the auxiliary combustion chamber.

17 Claims, 9 Drawing Sheets

SPARK PLUG FOR INTERNAL COMBUSTION ENGINE

CROSS-REFERENCE TO RELATED APPLICATION

This application is based on and claims the benefit of priority from Japanese Patent Application No. 2018-121715, filed Jun. 27, 2018. The entire disclosure of the above application is incorporated herein by reference.

BACKGROUND

Technical Field

The present disclosure relates to a spark plug for an internal combustion engine.

Related Art

A spark plug is used as a means for ignition in an internal combustion engine, such as engines for vehicles and cogeneration systems. In the spark plug in related art, a discharge gap is covered by a plug cover. An auxiliary combustion chamber is formed on an inner side of the plug cover.

SUMMARY

The present disclosure provides a spark plug for an internal combustion engine. The spark plug includes a cylindrical housing, a cylindrical insulator, a center electrode, a ground electrode, and a plug cover. The insulator is held on an inner side of the housing. The center electrode is held on an inner side of the insulator. The ground electrode forms a discharge gap with the center electrode. The plug cover, together with the housing, configures an auxiliary combustion chamber in which the discharge gap is arranged. The plug cover includes a spray hole that communicates between the inside and outside of the plug cover. The ground electrode is connected to a plurality of locations on an auxiliary-chamber inner wall surface that includes surfaces of the housing and the plug cover that are exposed to the auxiliary combustion chamber.

DESCRIPTION OF THE EMBODIMENTS

Figure 1:
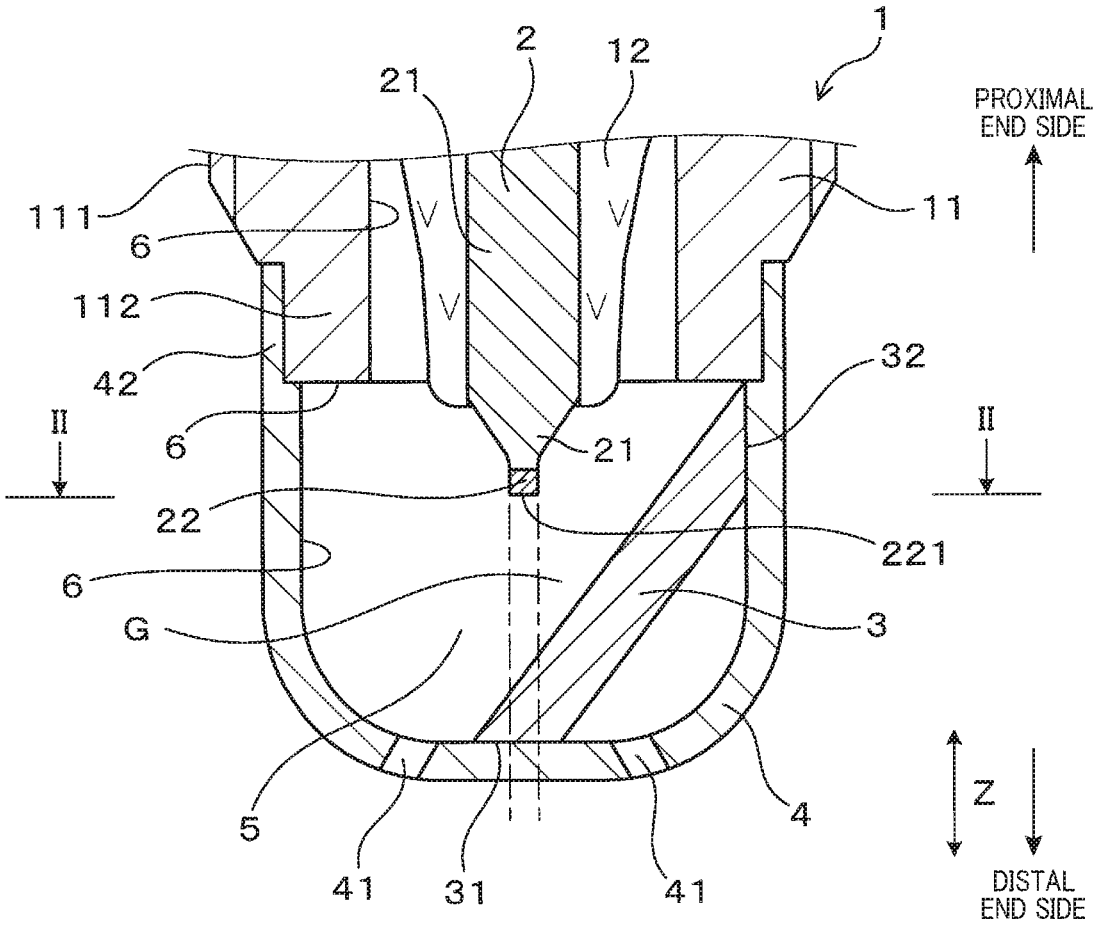
FIG. 1 is a cross-sectional view according to a first embodiment, in which the cross-section passes through a center axis of a spark plug and is parallel to an axial direction.

In the foregoing spark plug, an air-fuel mixture that is present inside a combustion chamber of the internal combustion engine is introduced into the auxiliary combustion chamber via a spray hole that is formed in the plug cover. In addition, the air-fuel mixture is ignited by spark discharge being performed in the discharge cap. A flame is thereby generated in the auxiliary combustion chamber. Then, a flame jet is shot from the spray hole into the combustion chamber outside the auxiliary combustion chamber, and the flame is spread throughout the combustion chamber. As a result, an internal combustion engine that has a high combustion speed can be obtained.

Here, in the spark plug in related art, a ground electrode is connected to the plug cover. An end portion of the ground electrode on a side opposite a connecting portion that is connected to the plug cover forms the discharge gap with a distal end surface of a center electrode.

In the spark plug in related art, heat from the ground electrode is mainly released into a housing through the plug cover that includes metal. However, a heat transmission distance to the housing at the portion of the ground electrode on the side (that is, the discharge gap side) opposite the side that is connected to the plug cover is long. Heat dissipation is poor. Therefore, this portion becomes excessively high in temperature. It is thought that pre-ignition and knocking may occur in the internal combustion engine.

It is thus desired to provide a spark plug for an internal combustion engine that is capable of improving heat dissipation of a ground electrode.

An exemplary embodiment of the present disclosure provides a spark plug for an internal combustion engine. The spark plug includes: a housing that has a cylindrical shape; an insulator that has a cylindrical shape and is held on an inner side of the housing; a center electrode that is held on an inner side of the insulator; a ground electrode that forms a discharge gap with the center electrode; and a plug cover that, together with the housing, configures an auxiliary combustion chamber in which the discharge gap is arranged, and includes a spray hole that communicates between the inside and outside of the plug cover. The ground electrode is connected to a plurality of locations on an auxiliary-chamber inner wall surface that includes surfaces of the housing and the plug cover that are exposed to the auxiliary combustion chamber.

In the spark plug for an internal combustion engine according to the above-described exemplary embodiment, the ground electrode is connected to a plurality of locations on the auxiliary-chamber inner wall surface. Therefore, heat in the ground electrode is dispersed towards the plurality of locations connected to the auxiliary-chamber inner wall surface and released. As a result, heat dissipation of the ground electrode can be improved.

As described above, according to the above-described exemplar embodiment, a spark plug for an internal combustion engine that is capable of improving heat dissipation of a ground electrode can be provided.

First Embodiment

A spark plug for an internal combustion engine according to a first embodiment will be described with reference to FIG. 1 and FIG. 2.

As shown in FIG. 1, a spark plug 1 for an internal combustion engine according to the present embodiment includes a housing 11, an insulator 12, a center electrode 2, and a ground electrode 3. The housing 11 has a cylindrical shape. The insulator 12 is held inside the housing 11. In addition, the insulator 12 has a cylindrical shape. The center electrode 2 is held inside the insulator 12. The ground electrode 3 forms a discharge gap G with the center electrode 2. A plug cover 4, together with the housing 11, configures an auxiliary combustion chamber 5 in which the discharge gap G is arranged. In addition, the plug cover 4 includes a spray hole 41 that communicates between the inside and outside of the plug cover 4. The ground electrode 3 is connected to a plurality of locations on an auxiliary-chamber inner wall surface 6. The auxiliary-chamber inner wall surface 6 includes surfaces of the housing 11 and the plug cover 4 that is exposed to the auxiliary combustion chamber 5. A detailed description according to the present embodiment will be given below.

In the present specification, a direction in which a center axis of the spark plug 1 extends is referred to as an axial direction Z. In addition, a side of the spark plug 1 in the axial direction Z on which the auxiliary combustion chamber 5 is formed is referred to as a distal end side (tip end side). A side of the spark plug 1 opposite the distal end side refers to a proximal end side (base end side). In addition, a circumferential direction of the spark plug 1 is simply referred to as a circumferential direction. Moreover, a radial direction of the spark plug 1 is simply referred to as a radial direction.

For example, the spark plug 1 can be used as an igniting means in an internal combustion engine for an automobile, in cogeneration, and the like. A proximal end portion of the spark plug 1 is connected to an ignition coil (not shown). A distal end portion of the spark plug 1 is arranged inside a combustion chamber of the internal combustion engine.

As shown in FIG. 1, an attachment screw portion 111 is formed in an outer circumferential portion of the housing 11. The spark plug 1 is screwed into a female screw hole that is provided in a cylinder head (not shown) by the attachment screw portion 111. The spark plug 1 is thereby attached to the cylinder head. In the state in which the spark plug 1 is attached to the cylinder head, a portion of the spark plug 1 that is further towards the distal end side than the attachment screw portion 111 is exposed to the combustion chamber.

As shown in FIG. 1, a circular cylindrical cover attaching portion 112 is provided on the distal end side of the attachment screw portion 111 of the housing 11. The cover attaching portion 112 protrudes towards the distal end side. An outer circumferential surface of the cover attaching portion 112 recesses further towards an inner circumferential side than the attachment screw portion 111. In addition, the plug cover 4 is attached to the cover attaching portion 112. That is, according to the present embodiment, the housing 11 and the plug cover 4 are separate components.

The plug cover 4 has an approximately hemispherical dome shape. The plug cover 4 has a shape of a rotating body of which the center axis of the spark plug is a rotation axis. The plug cover 4 is fixed to the cover attaching portion 112 of the housing 11 in a state in which an open end thereof is oriented towards the proximal end side. The plug cover 4 is arranged such that a proximal end portion 42 thereof covers the cover attaching portion 112 from the outer periphery. In the proximal end portion 42 of the plug cover 4, an inner circumferential surface recesses further towards the outer circumferential side than the distal end side portion. In addition, the proximal end portion 42 of the plug cover 4 is fitted onto the cover attaching portion 112 such that the cover attaching portion 112 is inserted into the recess. Furthermore, the proximal end portion 42 of the plug cover 4 is welded to the cover attaching portion 112 over the overall circumference thereof.

The plug cover 4 includes a plurality of spray holes 41 that communicate between the inside and outside of the plug cover 4. The plurality of spray holes 41 are formed at the distal end portion of the plug cover 4. In addition, the plurality of spray holes 41 are formed further towards the outer circumferential side in the radial direction than the center axis of the spark plug 1. The plurality of spray holes 41 are formed at an even interval in the circumferential direction. Each spray hole 41 is formed so as to be further towards the outer circumferential side in the radial direction, towards the distal end side in the axial direction Z. The quantity, shape, arrangement location, and the like of the spray holes 41 are determined as appropriate, as required.

A space surrounded by both the housing 11 and the plug cover 4 is the auxiliary combustion chamber 5. In addition, the surfaces of the housing 11 and the plug cover 4 that are exposed to the auxiliary combustion chamber 5 are the auxiliary-chamber inner wall surface 6. The ground electrode 3 is connected to a plurality of locations on the auxiliary-chamber inner wall surfaces 6 that are separated from each other.

Figure 2:
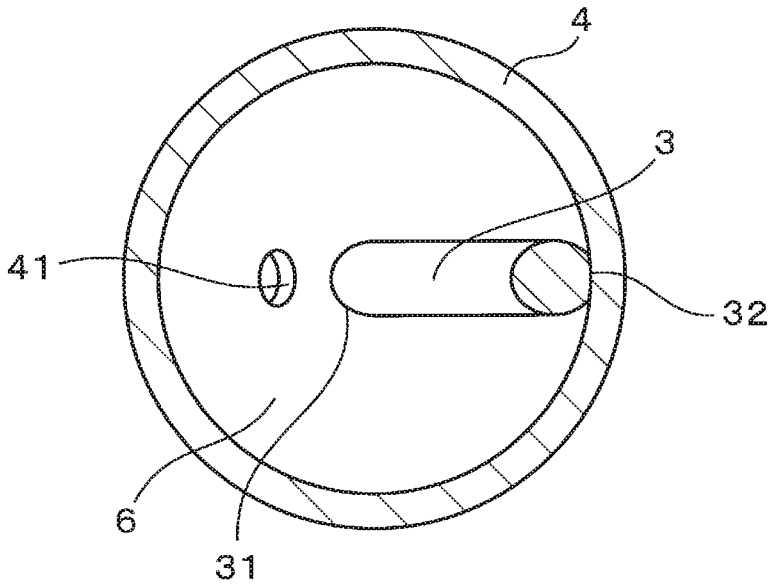
FIG. 2 is a cross-sectional view taken along line II-II in FIG. 1.

As shown in FIG. 1 and FIG. 2, the ground electrode 3 has a circular columnar shape that is formed so as to be straight. For example, the ground electrode 3 includes a Ni-based alloy of which a main component is Ni (that is, nickel). As shown in FIG. 1, according to the present embodiment, a diameter of the ground electrode 3 is greater than a thickness of the plug cover 4. According to the present embodiment, the ground electrode 3 is connected to only the plug cover 4, of the housing 11 and the plug cover 4 that configure the auxiliary-chamber inner wall surface 6.

The ground electrode 3 is connected to a plurality of locations on the auxiliary-chamber inner wall surface 6 of which the positions in the axial direction Z differ from one other. In the axial direction Z, a portion of the ground electrode 3 is connected to an area of the auxiliary-chamber inner wall surface 6 that is further towards the distal end side than a distal end surface 221 of the center electrode 2. Another portion of the ground electrode 3 is connected to an area of the auxiliary-chamber inner wall surface 6 that is further towards the proximal end side than the distal end surface 221 of the center electrode 2.

A distal end-side end portion 31 that is one end of the ground electrode 3 is connected to a position on the auxiliary-chamber inner wall surface 6 that overlaps the distal end surface 221 of the center electrode 2 in the axial direction Z. The distal end-side end portion 31 is positioned on the distal end side of the distal end surface 221 of the center electrode 2. The distal end-side end portion 31 is connected to a portion of the plug cover 4 at which a heat transmission distance to the connecting portion (that is, the proximal end portion 42) that is connected to the housing 11 is the farthest, or in the periphery of this portion. In the cross-sectional view in FIG. 1, an outer-shape position of the distal end surface 221 of the center electrode 2 in a direction perpendicular to the axial direction Z is shown by single-dot chain lines.

In addition, a proximal end-side end portion 32 that is an end portion of the ground electrode 3 on the side opposite the distal end-side end portion 31 is connected to a portion of the auxiliary-chamber inner wall surface 6 that is adjacent to the proximal end portion 42 of the plug cover 4 on the distal end side. The proximal end-side end portion 32 of the ground electrode 3 is formed in a position on the auxiliary-chamber inner wall surface 6 that is adjacent to the distal end surface of the cover attaching portion 112 of the housing 11 on the distal end side. Here, in terms of improvement in attachability of the plug cover 4 to the housing 11, a space is preferably formed between the proximal end-side end portion 32 of the ground electrode 3 and the distal end surface of the cover attaching portion 112. At least a portion of the proximal end-side end portion 32 of the ground electrode 3 is arranged further towards the proximal end side in the axial direction Z than the distal end surface 221 of the center electrode 2. In addition, a portion of the ground electrode 3 between the distal end-side end portion 31 and the proximal end-side end portion 32 is exposed to the auxiliary combustion chamber 5 over an overall circumference thereof. As a result, the ground electrode 3 can be suppressed from inhibiting the spreading of a flame that is generated in the auxiliary combustion chamber 5.

The ground electrode 3 is connected to the plug cover 4 at both end portions by welding. The ground electrode 3 forms the discharge gap G with the distal end surface 221 of the center electrode 2 in a center portion in a longitudinal direction. The center portion of the ground electrode 3 in the longitudinal direction is closest to the distal end surface 221 of the center electrode 2 in a direction perpendicular to the longitudinal direction of the ground electrode 3. The discharge gap G in which a spark discharge is generated is formed between this center portion and the distal end surface 221 of the center electrode 2.

The housing 11, the plug cover 4, and the ground electrode 3 include materials that have electric conductivity and thermal conductivity. In addition, the housing 11, the plug cover 4, and the ground electrode 3 are thermally and electrically connected to one another.

The insulator 12 is held inside the housing 11. A distal end portion of the insulator 12 protrudes towards the distal end side of the attachment screw portion 111 of the housing 11. A proximal end portion of the insulator 12 protrudes towards the proximal end side of the housing 11. The center electrode 2 is inserted and held in a distal end portion on the inner side of the insulator 12.

A distal end portion of the center electrode 2 is exposed from the insulator 12 on the distal end side. The center electrode 2 includes a center electrode member 21 and a center electrode chip 22 that is attached to a distal end of the center electrode member 21. For example, the center electrode member 21 includes a Ni-based alloy. In addition, for example, the center electrode chip 22 includes Pt (that is, platinum) and formed into a circular columnar shape. Furthermore, a distal end surface 221 of the center electrode chip 22 forms the discharge gap G with the ground electrode 3.

Next, working effects according to the present embodiment will be described.

In the spark plug 1 for an internal combustion engine according to the present embodiment, the ground electrode 3 is connected to a plurality of locations on the auxiliary-chamber inner wall surface 6. Therefore, heat in the ground electrode 3 is dispersed towards the plurality of locations connected to the auxiliary-chamber inner wall surface 6 and released. As a result, heat dissipation of the ground electrode 3 can be improved.

In addition, the ground electrode 3 is connected to a plurality of locations on the auxiliary-chamber inner wall surface 6 of which the positions in the axial direction Z differ from one another. Therefore, uniformity of temperature distribution in the plug cover 4 can be facilitated. That is, the distal end side of the plug cover 4 is close to a center portion of the combustion chamber. In addition, the heat transmission distance to the housing 11 on the distal end side of the plug cover 4 is far. Therefore, the plug cover 4 tends to be higher in temperature towards the distal end side. Thus, as a result of the ground electrode 3 being connected to a plurality of locations on the auxiliary-chamber inner wall surface 6 of which the positions in the axial direction Z differ from one another, heat in the portion of the plug cover 4 on the distal end side is efficiently released through the ground electrode 3. Consequently, the distal end side portion of the plug cover 4 becoming locally high in temperature can be easily prevented.

In addition, the ground electrode 3 is connected to a position on the auxiliary-chamber inner wall surface 6 that overlaps the distal end surface 221 of the center electrode 2 in the axial direction Z. Here, in the portion of the auxiliary-chamber inner wall surface 6 that overlaps the distal end surface 221 of the center electrode 2 in the axial direction Z, the heat transmission distance to the housing 11 is particularly far. Therefore, this portion particularly tends to be high in temperature. Thus, as a result of the ground electrode 3 being connected to the position on the auxiliary-chamber inner wall surface 6 that overlaps the distal end surface 221 of the center electrode 2 in the axial direction Z, heat in the periphery of the portion of the plug cover 4 that overlaps with the distal end surface 221 of the center electrode 2 in the axial direction Z can be efficiently released through the ground electrode 3.

In addition, in the axial direction Z, a portion of the ground electrode 3 is connected to an area of the auxiliary-chamber inner wall surface 6 that is further towards the distal end side than the distal end surface 221 of the center electrode 2. Another portion is connected to an area of the auxiliary-chamber inner wall surface 6 that is further towards the proximal end portion than the distal end surface 221 of the center electrode 2. Therefore, heat in the distal end-side portion of the plug cover 4 can be easily released to the housing 11 side through the ground electrode 3. Consequently, the plug cover 4 can be prevented from becoming locally high in temperature. Uniformity of temperature distribution in the plug cover 4 can be facilitated.

Furthermore, the housing 11 and the plug cover 4 are separate components. The ground electrode 3 is connected to only the plug cover 4, of the housing 11 and the plug cover 4 that configure the auxiliary-chamber inner wall surface 6.

Therefore, in manufacturing of the spark plug 1, first, the ground electrode 3 is connected to the plug cover 4. Subsequently, the plug cover 4 is attached to the housing 11. As a result, the spark plug 1 can be easily manufactured.

As described above, according to the present embodiment, a spark plug for an internal combustion engine that is capable of improving heat dissipation of a ground electrode is provided.

Second Embodiment

Figure 3:
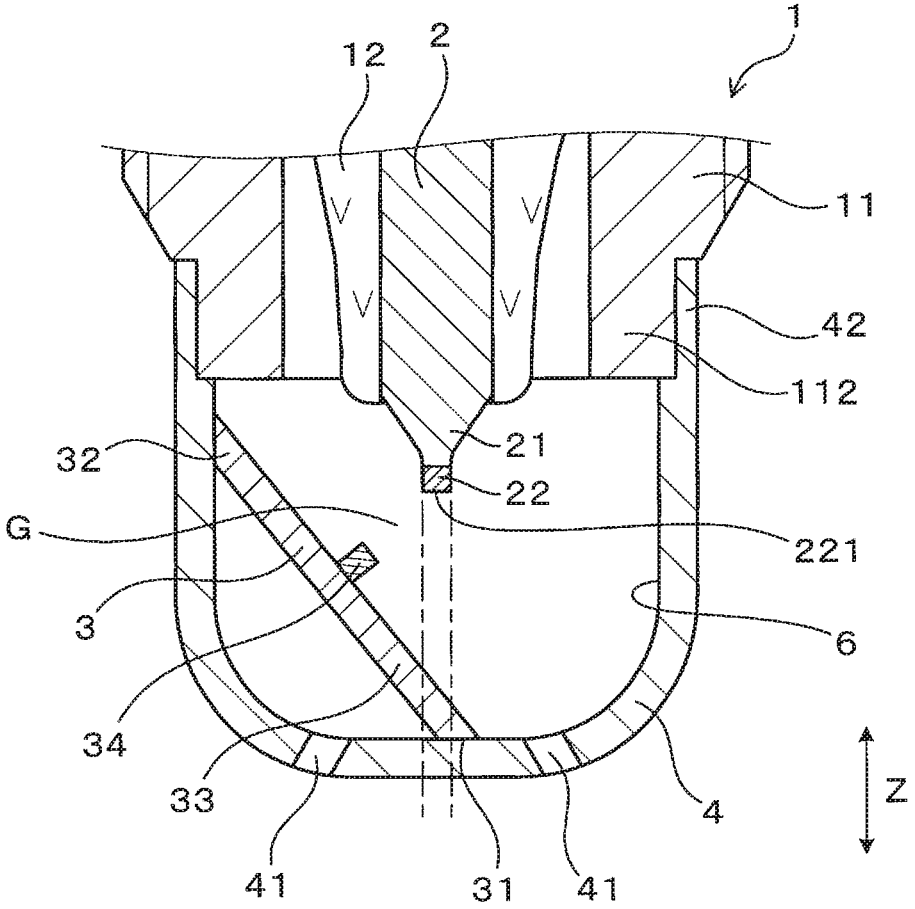
FIG. 3 is a cross-sectional view according to a second embodiment, in which the cross-section passes through the center axis of the spark plug and is parallel to the axial direction.

According to a second embodiment, as shown in FIG. 3, the shape of the ground electrode 3 is changed from that according to the first embodiment.

According to the present embodiment, the ground electrode 3 includes a ground electrode base material 33 and a ground electrode chip 34. The ground electrode base material 33 composes a base material of the ground electrode 3. The ground electrode chip 34 is connected to the ground electrode base material 33. For example, the ground electrode base material 33 includes a Ni-based alloy. For example, the ground electrode chip 34 includes Pt. In addition, in the ground electrode 3, the ground electrode chip 34 forms the discharge gap G. That is, the ground electrode 3 is closest to the distal end surface 221 of the center electrode at the ground electrode chip 34.

The ground electrode base material 33 has a circular columnar shape that is formed so as to be straight. A diameter of the ground electrode base material 33 is equal to or less than the thickness of the plug cover 4. The proximal end-side end portion 32 of the ground electrode base material 33 is connected to a position on the auxiliary-chamber inner wall surface 6 that is away from the distal end surface of the cover attaching portion 112 of the housing 11 towards the distal end side. Other connecting portions of the ground electrode base material 33 to the plug cover 4 are similar to the connecting portions of the ground electrode 3 to the auxiliary-chamber inner wall surface 6 according to the first embodiment.

The ground electrode chip 34 is joined to a surface in a center portion of the ground electrode base material 33 on a side facing the distal end surface 221 of the center electrode 2. The ground electrode chip 34 is formed into a circular columnar shape that has height in a direction in which the ground electrode chip 34 and the distal end surface 221 of the center electrode 2 are aligned. Here, the ground electrode chip 34 may have other shapes, such as a prismatic shape.

Other configurations are similar to those according to the first embodiment.

Here, of the reference numbers that are used according to the second and subsequent embodiments, the reference numbers that are the same as those used in a previous embodiment indicate constituent elements and the like that are similar to those according to the previous embodiment, unless otherwise noted.

According to the present embodiment, the ground electrode 3 includes the ground electrode base material 33 and the ground electrode chip 4 that is connected to the ground electrode base material 33. The ground electrode chip 34 forms the discharge gap G Therefore, for example, as a result of the ground electrode chip 34 including a material that has high wear resistance and the ground electrode base material 33 including a material that has high thermal conductivity, heat dissipation of the ground electrode 3 can be more easily ensured. In addition, as a result of the ground electrode chip 34 including a material that has high wear resistance, durability of the ground electrode 3 can be improved.

Other working effects are similar to those according to the first embodiment.

Third Embodiment

Figure 4:
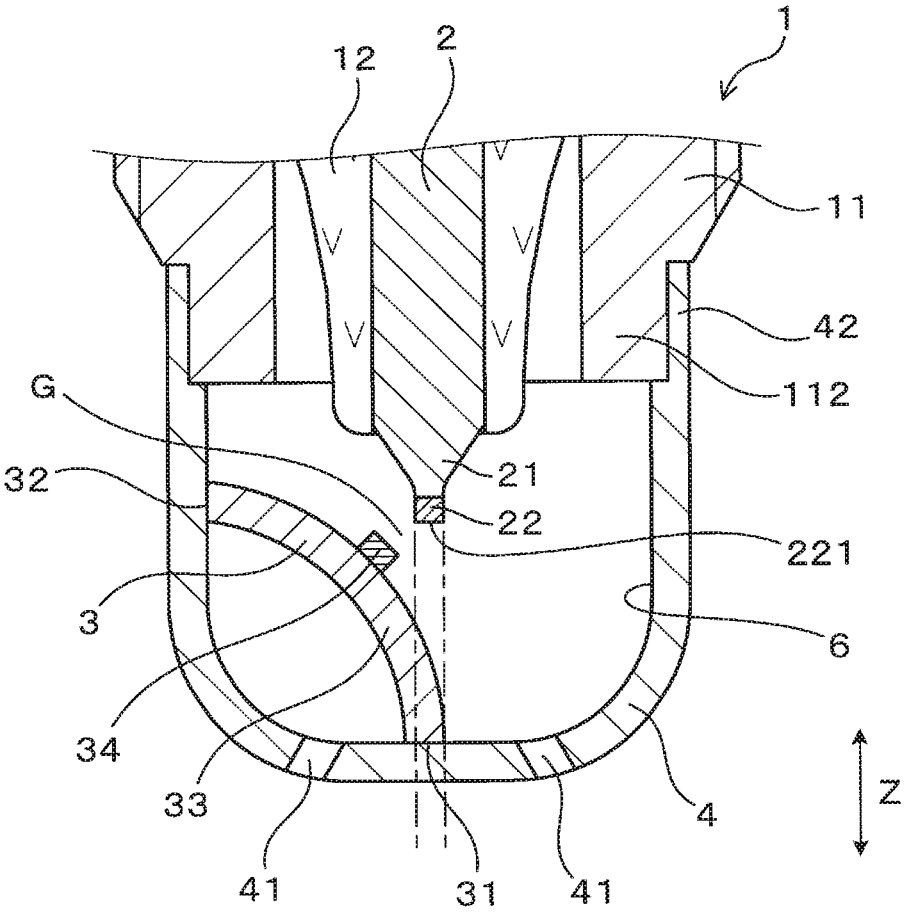
FIG. 4 is a cross-sectional view according to a third embodiment, in which the cross-section passes through the center axis of the spark plug and is parallel to the axial direction.

According to a third embodiment, as shown in FIG. 4, the shape of the ground electrode base material 33 is changed from that according to the second embodiment.

According to the present embodiment, the ground electrode 3 is curved so as to protrude towards the discharge gap G side. Specifically, the ground electrode base material 33 is shaped so as to expand towards the discharge gap G side, towards the center in the longitudinal direction. As a result, the overall ground electrode 3 has a curved shape that protrudes towards the discharge gap G side.

Other configurations are similar to those according to the second embodiment.

According to the present embodiment, the ground electrode 3 is curved so as to protrude towards the discharge gap G side. Therefore, portions of the ground electrode 3 other than the portion (the ground electrode chip 34 according to the present embodiment) that forms the discharge gap G can be set away from the distal end surface 221 of the center electrode 2. Consequently, occurrence of discharge with an unexpected portion of the ground electrode 3 serving as a point of origin can be prevented.

Other working effects are similar to those according to the second embodiment.

Fourth Embodiment

Figure 5:
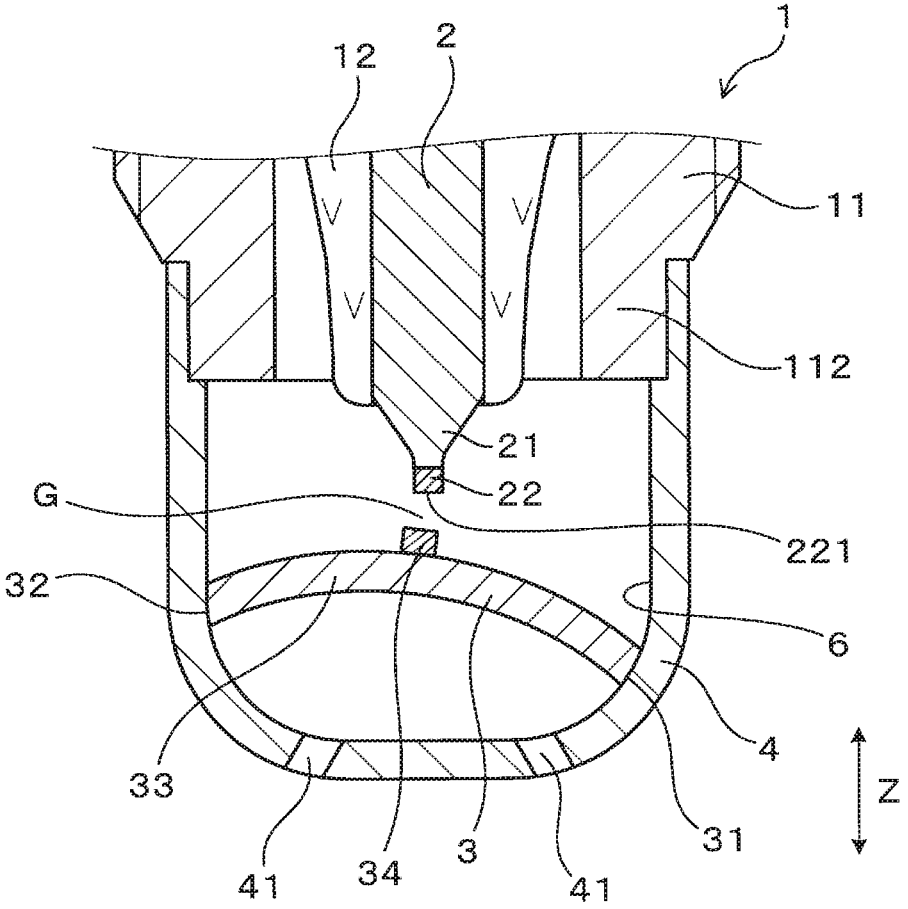
FIG. 5 is a cross-sectional view according to a fourth embodiment, in which the cross-section passes through the center axis of the spark plug and is parallel to the axial direction.

According to a fourth embodiment, as shown in FIG. 5, the positions at which the ground electrode 3 is connected to the auxiliary-chamber inner wall surface 6 are changed from that according to the third embodiment.

According to the present embodiment, both end portions of the ground electrode base material 33 are connected to positions on the auxiliary-chamber inner wall surface 6 that are on opposite sides of each other with the center axis of the spark plug 1 therebetween. Both end portions of the ground electrode base material 33 are connected to positions on the auxiliary-chamber inner wall surface 6 that differ in the axial direction Z. Here, the ground electrode base material 33 is not connected to a portion of the auxiliary-chamber inner wall surface 6 that overlaps the distal end surface 221 of the center electrode 2 in the axial direction Z.

Other configurations are similar to those according to the third embodiment.

According to the present embodiment as well, working effects similar to those according to the third embodiment are obtained.

Fifth Embodiment

Figure 6:
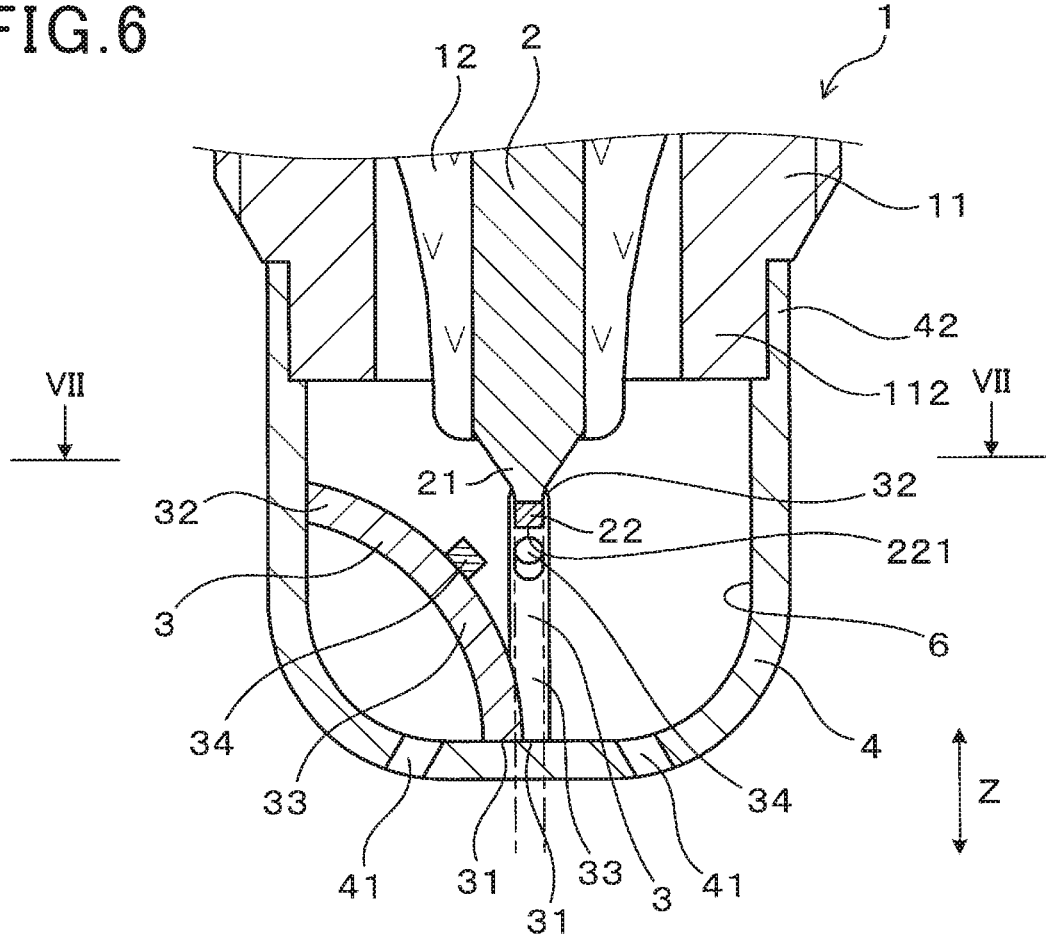
FIG. 6 is a cross-sectional view according to a fifth embodiment, in which the cross-section passes through the center axis of the spark plug and is parallel to the axial direction.
Figure 7:
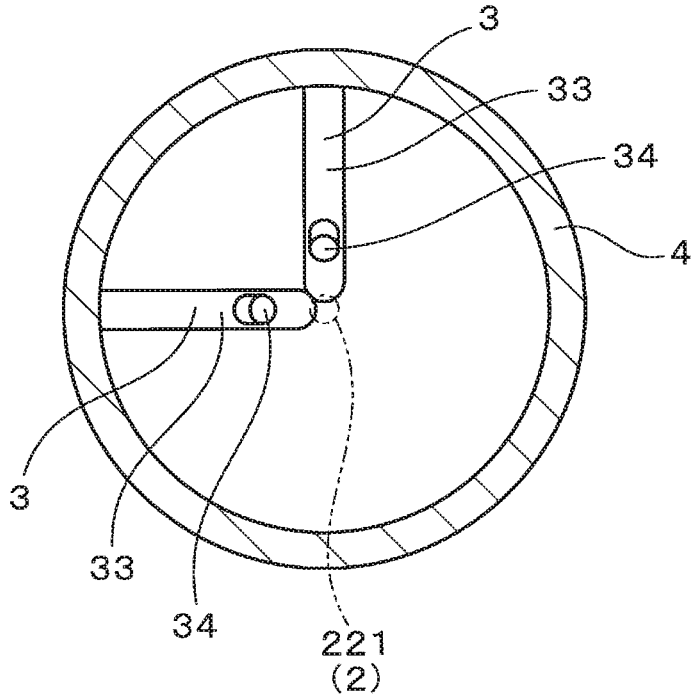
FIG. 7 is a cross-sectional view taken along line VII-VII in FIG. 6.

According to a fifth embodiment, as shown in FIG. 6 and FIG. 7, the spark plug 1 includes two ground electrodes 3. In FIG. 7, a projected contour in which the outer shape of the distal end surface 221 of the center electrode 2 is projected onto the plug cover 4 in the axial direction Z is shown by two-dotted chain lines.

According to the present embodiment, the two ground electrodes 3 have shapes that are equal to each other. However, the two ground electrodes 3 are arranged in attitudes that differ from each other. Each ground electrode 3 has a shape similar to that of the ground electrode 3 according to the third embodiment. The distal end-side end portion 31 of each ground electrode 3 is connected to a position on the auxiliary-chamber inner wall surface 6 that overlaps the distal end surface 221 of the center electrode 2 in the axial direction Z. Meanwhile, as shown in FIG. 7, the proximal end-side end portions 32 of the two ground electrodes 3 are connected to positions on the auxiliary-chamber inner wall surface 6 that are shifted from each other by 90 degrees in the circumferential direction. The spray holes are not shown in FIG. 7.

Other configurations are similar to those according to the third embodiment.

According to the present embodiment, heat in the distal end portion of the plug cover 4 is released through the plurality of ground electrodes 3. Therefore, heat release path for the heat in the distal end portion of the plug cover 4 can be increased. Uniformity of temperature distribution in the plug cover 4 can be further facilitated. In addition, as a result of the plurality of ground electrodes 3 being provided, overall heat capacity of the housing 11, the plug cover 4, and the ground electrode 3 can also be increased.

Other working effects are similar to those according to the third embodiment.

Sixth Embodiment

Figure 8:
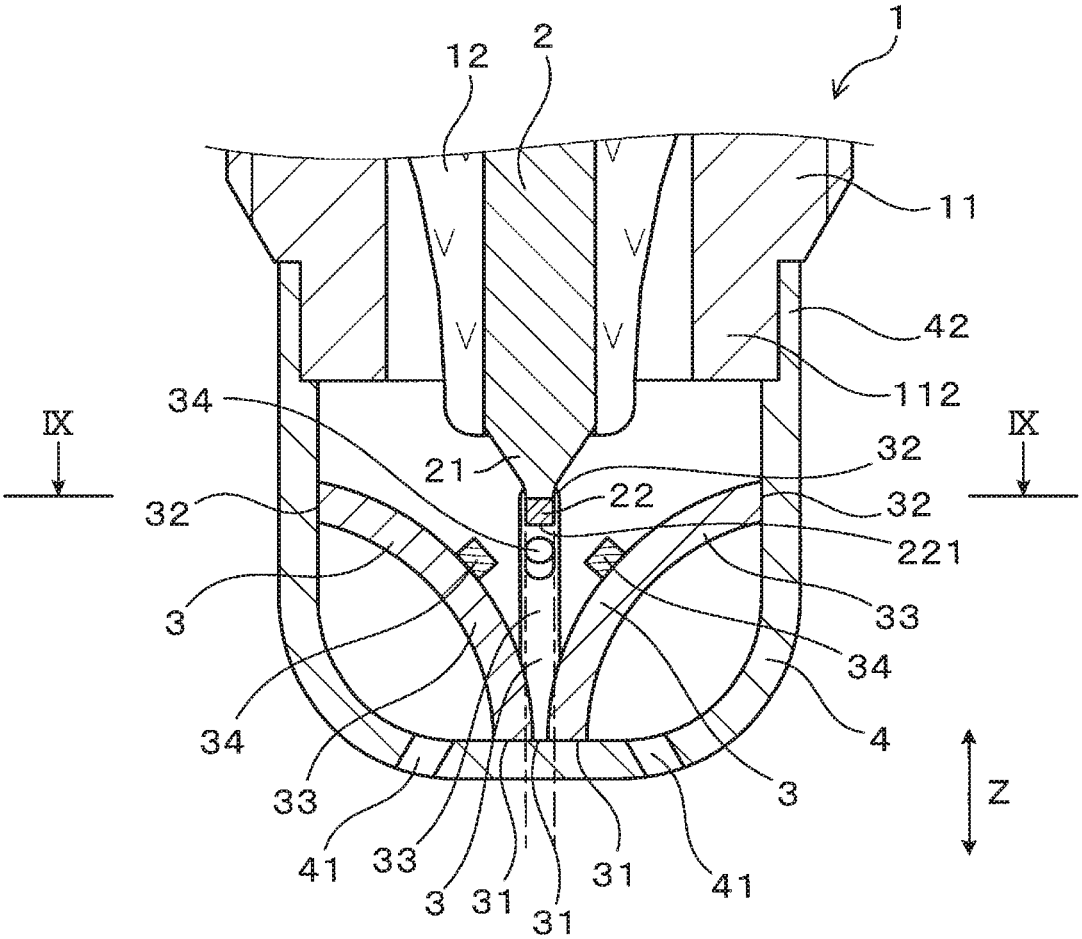
FIG. 8 is a cross-sectional view according to a sixth embodiment, in which the cross-section passes through the center axis of the spark plug and is parallel to the axial direction.
Figure 9:
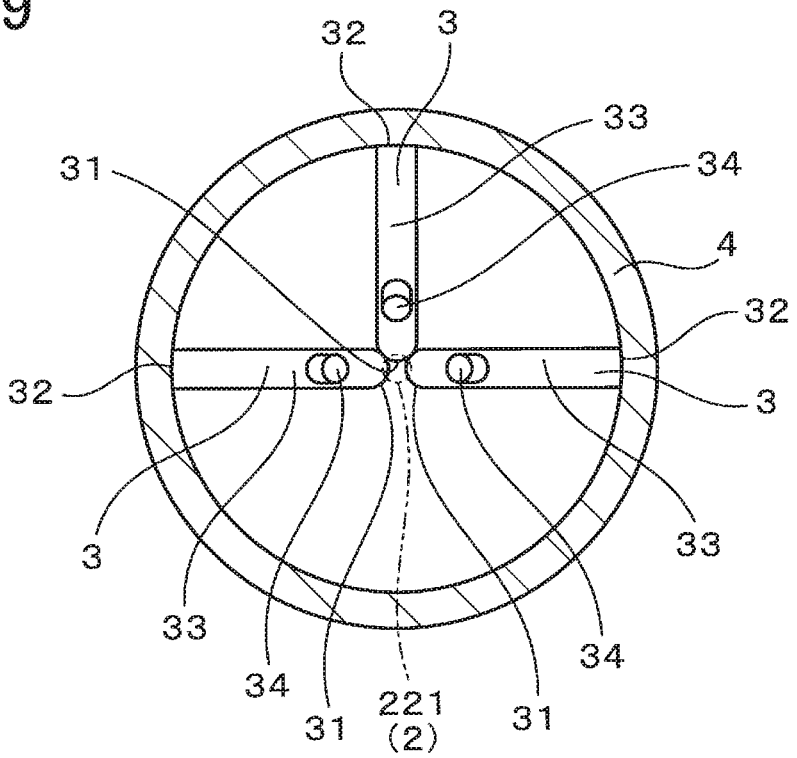
FIG. 9 is a cross-sectional view taken along line IX-IX in FIG. 8.

According to a sixth embodiment, as shown in FIG. 8 and FIG. 9, the spark plug 1 includes three ground electrodes 3.

According to the present embodiment, the three ground electrodes 3 have shapes that are equal to one another. However, the three ground electrodes 3 are arranged in attitudes that differ from one another. Each ground electrode 3 has a shape similar to that of the ground electrode 3 according to the third embodiment. The distal end-side end portion 31 of each ground electrode 3 is connected to a position on the auxiliary-chamber inner wall surface 6 that overlaps the distal end surface 221 of the center electrode 2 in the axial direction Z. Meanwhile, the proximal end-side end portions 32 of the three ground electrodes 3 are connected to positions on the auxiliary-chamber inner wall surface 6 that are shifted from each other by 90 degrees in the circumferential direction.

Other configurations are similar to those according to the fifth embodiment.

According to the present embodiment as well, working effects similar to those according to the fifth embodiment are obtained.

Seventh Embodiment

Figure 10:
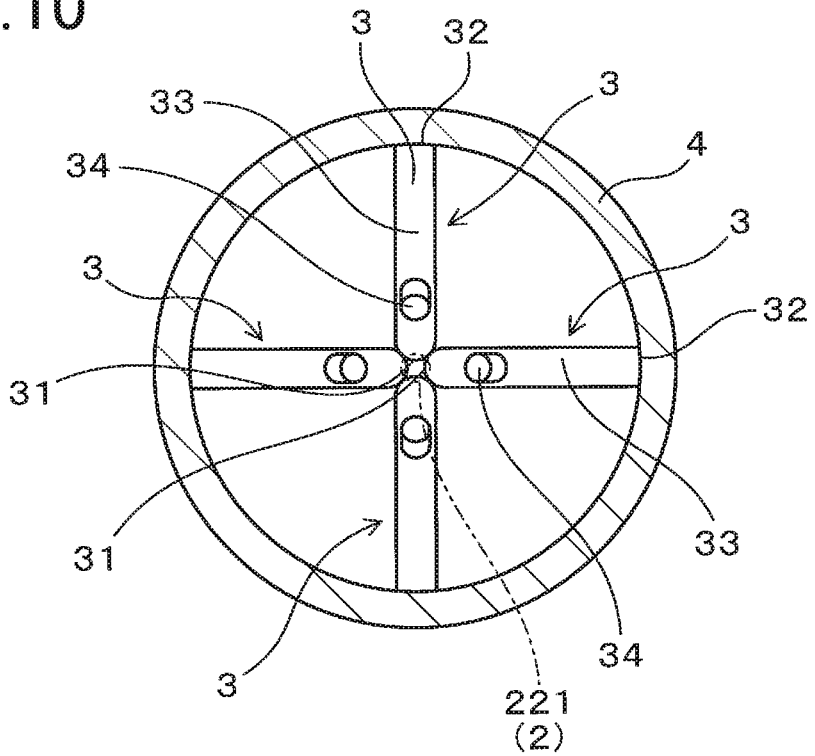
FIG. 10 is a cross-sectional view according to a seventh embodiment, in which the cross-section is perpendicular to the axial direction and passes through a portion of a ground electrode on a proximal end side.

According to a present embodiment, as shown in FIG. 10, the spark plug 1 includes four ground electrodes 3.

According to the present embodiment, the four ground electrodes 3 have shapes that are equal to one another. However, the four ground electrodes 3 are arranged in attitudes that differ from one another. Each ground electrode 3 has a shape similar to that of the ground electrode 3 according to the third embodiment. The distal end-side end portion 31 of each ground electrode 3 is connected to a position on the auxiliary-chamber inner wall surface 6 that overlaps the distal end surface 221 of the center electrode 2 in the axial direction Z. Meanwhile, the proximal end-side end portions 32 of the four ground electrodes 3 are connected to positions on the auxiliary-chamber inner wall surface 6 that are shifted from each other by 90 degrees in the circumferential direction.

Other configurations are similar to those according to the fifth embodiment.

According to the present embodiment as well, working effects similar to those according to the fifth embodiment are obtained.

Eighth Embodiment

Figure 11:
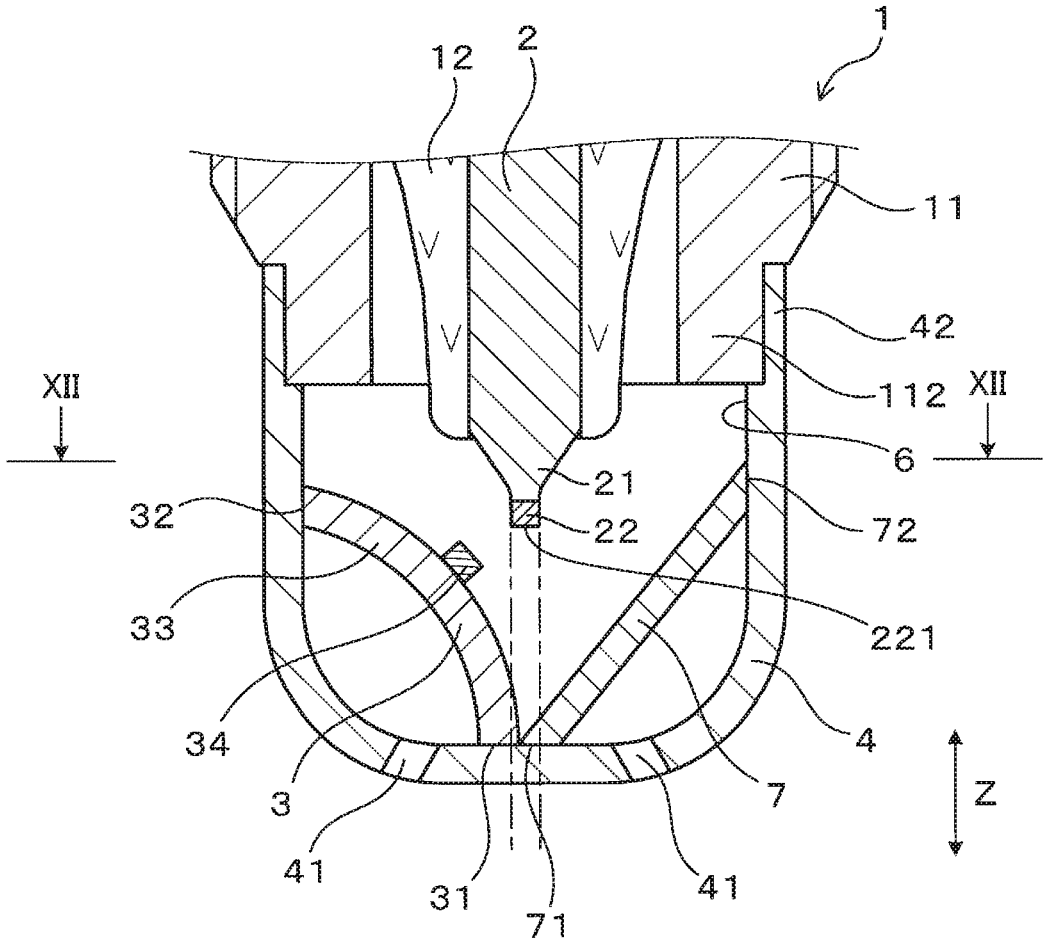
FIG. 11 is a cross-sectional view according to an eighth embodiment, in which the cross-section passes through the center axis of the spark plug and is parallel to the axial direction.
Figure 12:
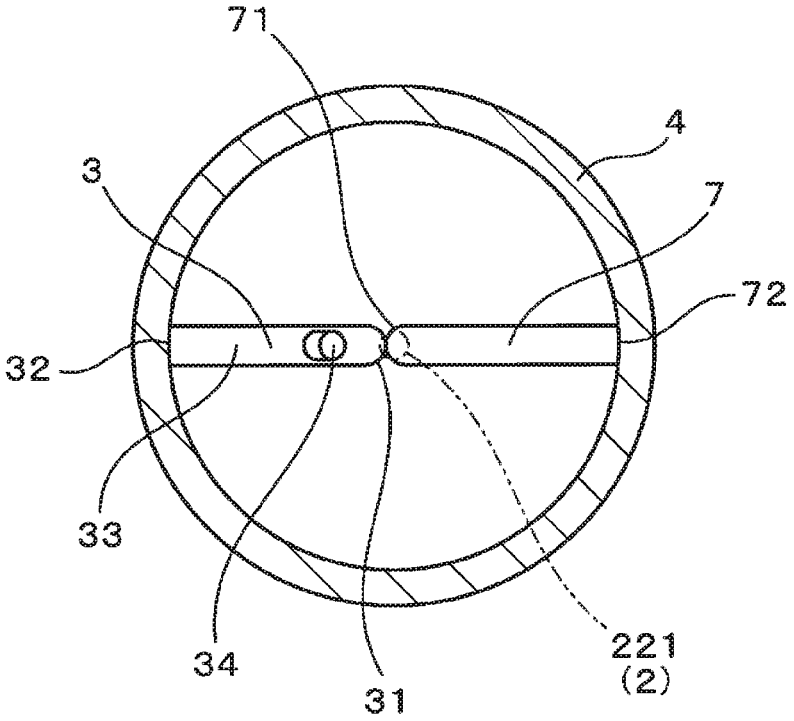
FIG. 12 is a cross-sectional view taken along line XII-XII in FIG. 11.

According to an eighth embodiment, as shown in FIG. 11 and FIG. 12, a bypass member 7 that is connected to a plurality of locations on the auxiliary-chamber inner wall surface 6 is further provided.

According to the present embodiment, a basic structure is similar to that according to the third embodiment. In addition, as shown in FIG. 12, one end of the bypass member 7 is connected to a position adjacent to the distal end-side end portion 31 of the ground electrode in the longitudinal direction of the ground electrode 3, when viewed from the axial direction Z. The ground electrode 3 and the bypass member 7 are arranged in a linear manner when viewed in the axial direction Z.

The bypass member 7 has a circular columnar shape that is formed so as to be straight. The bypass member 7 is connected to a plurality of locations on the auxiliary-chamber inner wall surface 6 of which the positions in the axial direction Z differ from one another. A distal end-side end portion 71 of the bypass member 7 is connected to an area of the auxiliary-chamber inner wall surface 6 that is further towards the distal end side than the distal end surface 221 of the center electrode 2. A proximal-end-side end portion 72 of the bypass member 7 is connected to an area of the auxiliary-chamber inner wall surface 6 that is further towards the proximal end side than the distal end surface 221 of the center electrode 2. The distal end-side end portion 71 of the bypass member 7 is connected to a position on the auxiliary-chamber inner wall surface 6 that overlaps the distal end surface 221 of the center electrode 2 in the axial direction Z.

The proximal end-side end portion 72 of the bypass member 7 is connected to a position on the auxiliary-chamber inner wall surface 6 that is shifted by 180 degrees in the circumferential direction from the portion to which the proximal end-side end portion 32 of the ground electrode 3 is connected. The proximal end-side end portion 72 of the bypass member 7 is connected to a position on the auxiliary-chamber inner wall surface 6 that is away from the proximal end portion 42 of the plug cover 4 towards the distal end side. At least a portion of the proximal end-side end portion 72 of the bypass member 7 is arranged further towards the proximal end side in the axial direction Z than the distal end surface 221 of the center electrode 2. The bypass member 7 is connected to the plug cover 4 at both end portions by welding.

A shortest distance between the bypass member 7 and the distal end surface 221 of the center electrode 2 is greater than the discharge gap G The shortest distance between the bypass member 7 and the distal end surface 221 of the center electrode 2 can be determined based on the shortest distance (that is, the length of the discharge gap G) between the ground electrode 3 and the distal end surface 221 of the center electrode 2. That is, the shortest distance between the bypass member 7 and the center electrode 2 is such that the bypass member 7 and the center electrode 2 are separated to an extent that discharge occurs in the discharge gap G, and discharge does not occur between the bypass member 7 and the distal end surface 221 of the center electrode 2.

Other configurations are similar to those according to the third embodiment.

According to the present embodiment, the bypass member 7 that is connected to a plurality of locations on the auxiliary-chamber inner wall surface 6 is further provided. Therefore, the heat release path for heat in the distal end portion of the plug cover 4 can be increased. Uniformity of temperature distribution in the plug cover 4 can be further facilitated. In addition, overall heat capacity of the housing 11, the plug cover 4, the ground electrode 3, and the bypass member 7 can also be increased.

Other working effects are similar to those according to the third embodiment.

The present disclosure is not limited to the above-described embodiments. Various embodiments are applicable without departing from the spirit of the present disclosure. For example, according to the above-described embodiments, the ground electrode 3 is connected to only the plug cover 4. However, the present disclosure is not limited thereto. A portion of the ground electrode 3 may be connected to the housing 11. In addition, in a similar manner, a portion of the bypass member 7 according to the eighth embodiment may be connected to the housing 11.

What is claimed is:

1. A spark plug for an internal combustion engine comprising:

a housing that has a cylindrical shape;

an insulator that has a cylindrical shape and is held on an inner side of the housing;

a center electrode that is held on an inner side of the insulator;

a ground electrode that forms a discharge gap with the center electrode; and a plug cover that, together with the housing, configures an auxiliary combustion chamber in which the discharge gap is arranged, and includes a spray hole that communicates between an inside and outside of the plug cover, the ground electrode being connected to a plurality of locations on an auxiliary-chamber inner wall surface that comprises surfaces of the housing and the plug cover that are exposed to the auxiliary combustion chamber configured by the housing and the plug cover, wherein the ground electrode is connected to a plurality of locations on the auxiliary-chamber inner wall surface of which positions in an axial direction differ from one another.

2. The spark plug for an internal combustion engine according to claim 1, wherein:

a portion of the ground electrode is connected to a position on the auxiliary-chamber inner wall surface that overlaps a distal end surface of the center electrode in an axial direction.

3. The spark plug for an internal combustion engine according to claim 2, wherein:

in an axial direction, a portion of the ground electrode is connected to an area on the auxiliary-chamber inner wall surface that is further towards a distal end side than a distal end surface of the center electrode is, and another portion is connected to an area of the auxiliary-chamber inner wall surface that is further towards a proximal end side than the distal end surface of the center electrode.

4. The spark plug for an internal combustion engine according to claim 3, wherein:

the ground electrode comprises a plurality of ground electrodes.

5. The spark plug for an internal combustion engine according to claim 4, further comprising:

a bypass member that is connected to a plurality of locations on the auxiliary-chamber inner wall surface.

6. The spark plug for an internal combustion engine according to claim 5, wherein:

the housing and the plug cover are separate components; and the ground electrode is connected to only the plug cover, of the housing and the plug cover that configure the auxiliary-chamber inner wall surface.

7. The spark plug for an internal combustion engine according to claim 6, wherein:

the ground electrode is curved so as to protrude towards the discharge gap side.

8. The spark plug for an internal combustion engine according to claim 7, wherein:

the ground electrode includes a ground electrode base material and a ground electrode chip that is connected to the ground electrode base material, in which the ground electrode chip forms the discharge gap.

9. The spark plug for an internal combustion engine according to claim 1, wherein:

a portion of the ground electrode is connected to a position on the auxiliary-chamber inner wall surface that overlaps a distal end surface of the center electrode in an axial direction.

10. The spark plug for an internal combustion engine according to claim 1, wherein:

in an axial direction, a portion of the ground electrode is connected to an area on the auxiliary-chamber inner wall surface that is further towards a distal end side than a distal end surface of the center electrode, and another portion is connected to an area of the auxiliary-chamber inner wall surface that is further towards a proximal end side than the distal end surface of the center electrode.

11. The spark plug for an internal combustion engine according to claim 1, wherein:

the ground electrode comprises a plurality of ground electrodes.

12. The spark plug for an internal combustion engine according to claim 1, further comprising:

a bypass member that is connected to a plurality of locations on the auxiliary-chamber inner wall surface.

13. The spark plug for an internal combustion engine according to claim 1, wherein:

the housing and the plug cover are separate components; and the ground electrode is connected to only the plug cover, of the housing and the plug cover that configure the auxiliary-chamber inner wall surface.

14. The spark plug for an internal combustion engine according to claim 1, wherein:

the ground electrode is curved so as to protrude towards the discharge gap side.

15. The spark plug for an internal combustion engine according to claim 1, wherein:

the ground electrode includes a ground electrode base material and a ground electrode chip that is connected to the ground electrode base material, in which the ground electrode chip forms the discharge gap.

16. A spark plug for an internal combustion engine comprising:

a housing that has a cylindrical shape;

an insulator that has a cylindrical shape and is held on an inner side of the housing;

a center electrode that is held on an inner side of the insulator;

a ground electrode that forms a discharge gap with the center electrode; and a plug cover that, together with the housing, configures an auxiliary combustion chamber in which the discharge gap is arranged, and includes a spray hole that communicates between an inside and outside of the plug cover, the ground electrode being connected to a plurality of locations on an auxiliary-chamber inner wall surface that comprises surfaces of the housing and the plug cover that are exposed to the auxiliary combustion chamber configured by the housing and the plug cover; wherein:

a portion of the ground electrode is connected to a position on the auxiliary-chamber inner wall surface that overlaps a distal end surface of the center electrode in an axial direction.

17. A spark plug for an internal combustion engine comprising:

a housing that has a cylindrical shape;

an insulator that has a cylindrical shape and is held on an inner side of the housing;

a center electrode that is held on an inner side of the insulator;

a ground electrode that forms a discharge gap with the center electrode; and a plug cover that, together with the housing, configures an auxiliary combustion chamber in which the discharge gap is arranged, and includes a spray hole that communicates between an inside and outside of the plug cover, the ground electrode being connected to a plurality of locations on an auxiliary-chamber inner wall surface that comprises surfaces of the housing and the plug cover that are exposed to the auxiliary combustion chamber configured by the housing and the plug cover; wherein:

in an axial direction, a portion of the ground electrode is connected to an area on the auxiliary-chamber inner wall surface that is further towards a distal end side than a distal end surface of the center electrode, and another portion is connected to an area of the auxiliary-chamber inner wall surface that is further towards a proximal end side than the distal end surface of the center electrode.

* * * * *